US005512817A

United States Patent [19]

Nagaraj

[11] Patent Number: 5,512,817

[45] Date of Patent: Apr. 30, 1996

[54] BANDGAP VOLTAGE REFERENCE GENERATOR

[75] Inventor: Krishnaswamy Nagaraj, Wescosville, Pa.

[73] Assignee: AT&T Corp., Murray Hill, N.J.

[21] Appl. No.: 175,076

[22] Filed: Dec. 29, 1993

[51] Int. Cl.[6] ..... G05F 3/30

[52] U.S. Cl. ..... 323/316; 323/907; 327/539

[58] Field of Search ..... 323/299, 313–316, 323/907; 327/539, 542

[56] References Cited

U.S. PATENT DOCUMENTS

| | | | |
|---|---|---|---|
| 4,839,535 | 6/1989 | Miller | 327/539 |
| 4,849,684 | 7/1989 | Sonntag et al. | 323/313 |
| 5,168,210 | 12/1992 | Thus | 323/313 |
| 5,245,273 | 9/1993 | Greaves et al. | 323/313 |
| 5,309,083 | 5/1994 | Pierret et al. | 323/313 |
| 5,391,980 | 2/1995 | Thiel et al. | 323/314 |

*Primary Examiner*—Peter S. Wong
*Assistant Examiner*—Shawn Riley

[57] ABSTRACT

A bandgap voltage generator using a simple bandgap voltage reference supply circuit which has virtually no power supply rejection ratio (PSRR) which can produce an output bandgap voltage, $V_{BG}$, using an extremely low power supply voltage, $V_{DD}$. In order to increase the PSRR, a signal generated by the bandgap voltage reference supply circuit is amplified by a high gain amplifier circuit comprised of two cascode connected FETs. The highly amplified signal generated by the high gain amplifier circuit drives a voltage regulator, comprised of an FET used as a voltage controlled current sink, which regulates the voltage supplied from the power supply, $V_{DD}$, to the bandgap voltage reference supply circuit. This combination of a bandgap voltage reference with virtually no PSRR and a high gain amplifier results in a bandgap voltage generator with a very high PSRR.

16 Claims, 1 Drawing Sheet

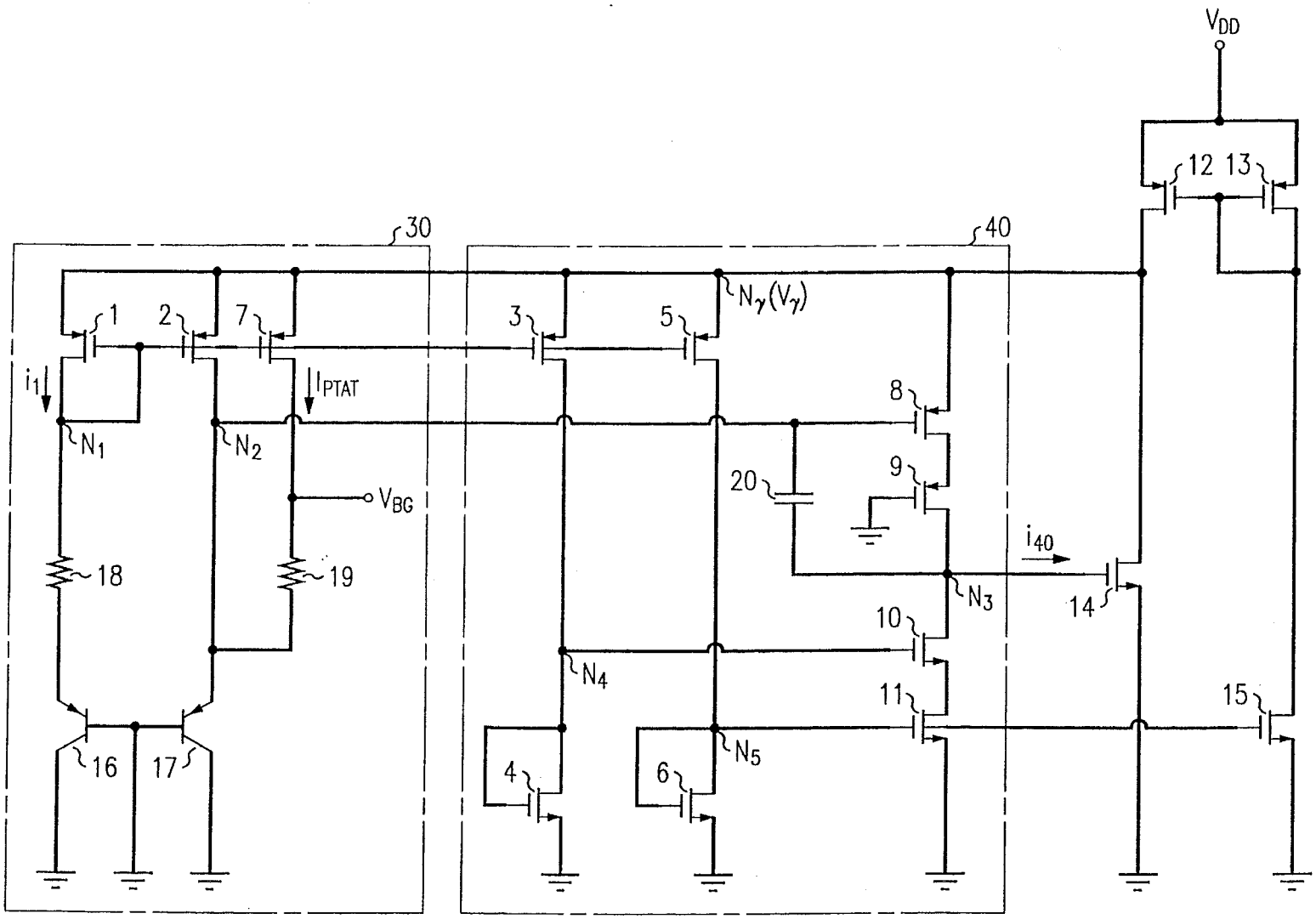
VDD
12
13
15
14
i40
40
N3
8
9
10
11
20
Nγ(Vγ)
N5
5
6
N4
3
4
30
VBG
IPTAT
19
7
N2
2
17
1
N1
18
16
i1

BANDGAP VOLTAGE REFERENCE GENERATOR

FIELD OF THE INVENTION

The present invention relates to bandgap voltage reference generators, and more particularly, to bandgap voltage reference generators implemented in complementary metal-oxide-silicon integrated circuit technology.

BACKGROUND OF THE INVENTION

The use of portable battery operated devices that employ very complex high performance electronic circuitry has increased dramatically over recent years with the widespread use of cellular telephones and laptop computers, among other devices. In addition, for precision coders/decoders (CODECS), the conversion accuracy of signals from analog to digital and back again is directly dependent on the stability of the reference voltage. For proper and reliable operation, such devices require a reference or bandgap voltage, $V_{BG}$, typically of about 1.25 volts, that is stable and immune to temperature variations, power supply variations and noise.

It is also desirable for the reference voltage, $V_{BG}$, to be driven by a power source, $V_{DD}$, that can retain power for long periods of time before recharging is required. To meet this requirement, a number of batteries or a single large battery is generally needed, thereby increasing the size and weight of the overall device and making the device less desirable or suitable for portable use. However, if the voltage of the power source, $V_{DD}$, can be minimized, the number and size of the batteries required may also be reduced.

Typically, a circuit known as a bandgap voltage reference generator is used to provide the required stable reference or bandgap voltage, $V_{BG}$. A CMOS bandgap voltage reference generator with a high power supply rejection ratio (PSRR)—the ratio of the change in the power source, $V_{DD}$, to a change in bandgap voltage, $V_{BG}$—which is useful, for example, in analog integrated circuits is disclosed in U.S. Pat. No. 4,849,684. In that device, a magnified current derived from a thermal voltage reference produces a voltage drop across a resistor. The resistor is coupled to a bipolar transistor which is part of the thermal voltage reference. The bandgap voltage is the sum of the voltage across the resistor and the voltage across the bipolar transistor. The bandgap portion of the disclosed circuit itself has a PSRR of only about 30–40 decibels. A differential amplifier senses the voltages at the control current input and the output of a current mirror in the thermal voltage reference portion of the bandgap voltage reference and adjusts the power supply voltage to the thermal voltage reference until the sensed voltages are substantially the same. The differential amplifier enhances the PSRR of the circuit to about 100 decibels.

Although the bandgap voltage reference generator disclosed in U.S. Pat. No. 4,849,684 is reliable, functional and useful for many applications, its circuitry requires a power source, $V_{DD}$, Of at least about 4 volts to produce a reference or bandgap voltage, $V_{BG}$, of about 1.25 volts. This minimum voltage level of the power source, $V_{DD}$, is due to the fact that the regulator transistors (FETs 22 and 23) produce a threshold voltage drop of about 3 volts. Consequently, the voltage source, $V_{DD}$, must be in excess of at least about 4 volts to produce an output bandgap voltage, $V_{BG}$, of about 1.25 volts.

SUMMARY OF THE INVENTION

The bandgap voltage generator of the present invention uses a simple bandgap voltage reference supply circuit which has virtually no PSRR, but which can produce an output bandgap voltage, $V_{BG}$, of from about 1.0 to about 1.5 volts, preferably about 1.25 volts, using an extremely low source of voltage, $V_{\gamma}$, of about 2.0 volts driven by a power supply, $V_{DD}$, with a very low voltage specifically, from about 2.3 to about 5.0 volts, preferably from about 2.3 to about 3.6 volts, and most preferably about 3.0 volts. Consequently, the physical size of the device, such as a battery, providing the power supply voltage, $V_{DD}$, may also be minimized. The bandgap voltage reference supply circuit is primarily comprised of a current loop including a current mirror comprised of two FETs, two bipolar transistors and a resistor. A second current mirror and a second resistor are used to provide the required output bandgap voltage, $V_{BG}$. This current loop requires a relatively low voltage for operation but does not in itself supply a PTAT current, $I_{PTAT}$, independent of the power supply. In order to increase the PSRR of the circuit, a signal generated by the bandgap voltage reference supply circuit is amplified by a high gain amplifier circuit which is comprised of two cascode connected FETs. The highly amplified signal generated by the high gain amplifier circuit is used to drive a voltage regulator which regulates the voltage, $V_{\gamma}$, supplied from the power supply, $V_{DD}$, to the bandgap voltage reference supply circuit. The voltage regulator is comprised of a FET used as a voltage controlled current sink. The high gain amplifier and the voltage regulator together increase the PSRR of the bandgap voltage generator of the present invention to about 100 decibels, even in view of the fact that the device is operated with a bandgap voltage reference with virtually no PSRR. However, it is precisely this low PSRR bandgap voltage reference that allows the bandgap voltage generator of the present invention to operate with such a low power supply voltage.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWING

FIG. 1 is a schematic diagram of the bandgap voltage reference generator in accordance with one embodiment of the present invention.

DETAILED DESCRIPTION OF THE PREFERRED EMBODIMENT

Referring to FIG. 1 in which a preferred embodiment of the bandgap voltage generator of the present invention is shown, the voltage generator is driven by a power supply $V_{DD}$ which is from about 2.3 to about 5.0 volts, preferably from about 2.3 to about 3.6 volts, and most preferably about 3.0 volts. Power supply voltage $V_{DD}$ is supplied through FET 12 to node $N_{\gamma}$ which has a voltage, $V_{\gamma}$, equal to $V_{DD}$ reduced by the voltage drop across FET 12. The voltage, $V_{\gamma}$, at node $N_{\gamma}$ can be as low as about 2.0 volts and is applied to FETs 1, 2, 3, 5, 7, 8 and 14. FETs 1, 2, 3, 5, 7 and 8 are selected so that they have substantially identical current and voltage characteristics.

A bandgap voltage reference or supply 30 is formed by the current loop comprising FETs 1 and 2, transistors 16 and 17, and resistor 18 and by the circuit comprising resistor 19 and the current mirror formed by FET 7. In order to generate a bandgap voltage, $V_{BG}$, a PTAT current, $i_{PTAT}$, is required which in turn requires that the voltages at nodes $N_1$ and $N_2$ be equal to one another, which is demonstrated as follows. Because the gate of FET 8 is connected to node $N_2$, FET 8 senses any voltage variations at node $N_2$. As discussed in detail below, voltage variations at node $N_2$ are amplified by the high gain amplifier circuit 40 formed by FETs 3, 4, 5, 6, 8, 9, 10 and 11 and capacitor 20 which, by controlling the operation of FET 14, compensates for such voltage variations. The voltage at node $N_2$ is equal to the voltage, $V_\gamma$, at node $N_\gamma$ minus the gate to source voltage of FET 8, $V_{GS8}$:

$$V_{N2}=V_\gamma-V_{GS8}$$

The voltage at node $N_1$ is equal to the voltage, $V_\gamma$ at node $N_\gamma$ minus the gate to source voltage of FET 1, $V_{GS1}$:

$$V_{N1}=V_\gamma-V_{GS1}$$

Under equilibrium, the drain currents of FETs 1 and 8 are equal. Also, because FETs 1 and 8 have substantially identical characteristics, their gate to source voltages, $V_{GS}$, are equal. As a result, the voltage at node $N_2$ is always equal to that at node $N_1$. Because the sources and gates of FETs 1, 2, 3, 5 and 7 are tied together, they form a current mirror so that their drain currents are equal to one another independent of ambient temperatures. Thus, the drain currents of FETs 2, 3, 5 and 7 satisfy the basic requirement for a PTAT current, $I_{PTAT}$. The drain current of FET 7, $I_{PTAT}$, is available to provide a voltage drop across resistor 19. Resistors 18 and 19 are selected so that the output bandgap voltage, $V_{BG}$, of the bandgap voltage reference 30 is equal to the desired level, from about 1.0 to 1.5 volts, preferably about 1.25 volts. By using this simple voltage reference circuit 30, which in itself provides no rejection of variations in the power supply, $V_{DD}$, the operating threshold voltage of the bandgap voltage reference 30 is very low so that the bandgap voltage reference 30 can be operated in conjunction with a power supply, $V_{DD}$, that is extremely low, in particular, as low as 2.3 to 3.6 volts.

Fluctuations in the output bandgap voltage, $V_{BG}$, which are caused by fluctuations in the voltage of the power supply, $V_{DD}$, are substantially eliminated by using a feedback mechanism that employs a very high gain amplifier circuit 40 which controls FET 14, that in turn controls the voltage, $V_\gamma$, at node $N_\gamma$. The drain of FET 14 is connected to node $N_\gamma$, so that, acting as a voltage controlled current sink, FET 14 provides a variable drain of current from node $N_\gamma$ to ground, thereby regulating the voltage, $V_\gamma$, at node $N_\gamma$. The gate of FET 14 is connected to node $N_3$. Consequently, the current output, $i_{40}$, of the high gain amplifier circuit 40 controls the operation of FET 14. The high gain amplifier 40 is comprised of FETs 3, 4, 5, 6, 8, 9, 10 and 11 and capacitor 20. The current at node N, is supplied to the gate of FET 8 and capacitor 20. The current leaving the drain of FET 3 is supplied to node $N_4$ and FETs 4 and 10. The gate and drain of FET 4 are tied together so that FET 4 acts as a load to the gate of FET 10. The current leaving the drain of FET 5, which is identical to the current leaving the drain of FET 3, is supplied to node N, and FETs 6 and 11. FETs 6 and 11 are selected so that they have substantially identical current and voltage characteristics. FET 4 is selected so that its width/length ratio is about one quarter to about one half of that of FETs 6 and 11, and FET 15 is selected so that its width/length ratio is about 1 to about 5 times that of FETs 6 and 11. The gate and drain of FET 6 are tied together so that FET 6 acts as a load to the gate of FET 11. As discussed above, because FETs 2, 3 and 5 are current mirrors, their drain currents are identical. The drain of FET 8 is cascode connected to the source of FET 9, and the drain of FET 9 is connected to node $N_3$. The drain of FET 11 is connected to the source of FET 10, and the drain of FET 10 is connected to node $N_3$. Because of the cascode connection of FETs 8 and 9, these two transistors comprise an amplifier with a very high gain, with FETs 10 and 11 together acting as the load to FETs 8 and 9. The output current, $i_{40}$, of the high gain amplifier circuit 40 at node $N_3$ is supplied to the gate of FET 14.

In operation, if there is a variation, $\Delta V_\gamma$, in the voltage, $V_\gamma$, at node $N_\gamma$ caused by a fluctuation in the power supply, $V_{DD}$, or by any other source, the voltage variation appears directly as a variation of the gate to source voltage, $V_{GS8}$, of FET 8, thereby causing the current passing through FET 8 to vary. The variation in the current through FET 8 is transmitted through FET 9 to node $N_3$ and to the gate of FET 14, thereby varying the operation of FET 14 which controls the voltage, $V_\gamma$, at node $N_\gamma$. Stated in another way, if the voltage $V_\gamma$, at node $N_\gamma$, increases, the drain current of FET 8 increases, thereby increasing the current, $i_{40}$, leaving the high gain amplifier circuit 40. The increased amplifier current, $i_{40}$, causes the source current leaving FET 14 to increase, thereby lowering the voltage, $V_\gamma$, at node $N_\gamma$, until it reaches its desired value which produces the predetermined bandgap voltage, $V_{BG}$.

The effect of a change, $\Delta V_\gamma$, in the voltage, $V_\gamma$, at $N_\gamma$ can also be calculated quantatively. Such a voltage change, $\Delta V_\gamma$, in addition to effecting FET 8, also causes a variation, $\Delta i_1$, of the drain current, $i_1$, through FET 1 which travels though resistor 18 and transistor 16. Thus:

$$\Delta i_1=\frac{\Delta V_\gamma}{\frac{1}{g_1}+R_{18}+\frac{1}{g_{16}}}$$

where $g_1$, is the transconductance of FET 1, $R_{18}$ is the resistance of resistor 18, and $g_{16}$ is the transconductance of transistor 16. The current variation through FET 1, $\Delta i_1$, is mirrored into FET 11 through FET 5 and into FET 10 through FET 3. Because the drain current from FET 5 mirrors that of FET 1, and because FET 6 and FET 11 have the same characteristics, the source current, $i_{11}$, of FET 11 will be equal to the drain current, $i_1$, of FET 1. The current, $i_{11}$, through FET 11 also passes through FET 10 and node N3. The variation in the current, $\Delta i_8$, through FET 8 is:

$$\Delta i_8=\Delta V_\gamma\times g_8$$

where $g_8$ is the transconductance of FET 8. Because FET 8 has the same current and voltage characteristics as FET 1, the transconductance of FET 8 is equal to that of FET 1, thus:

$$\Delta i_8=\Delta V_\gamma\times g_1$$

The current, $i_8$, through FET 8 passes through FET 9 to node $N_3$. Consequently, the net current, $i_{40}$, from amplifier 40 leaving node $N_3$ to enter gate of FET 14 is:

$$\Delta i_{40}=\Delta i_8-\Delta i_{11}$$

Any changes, $\Delta i_8$, in the current through FET 8 will always be greater than the changes, $\Delta i_{11}$, in the current through FET 11 so that the current change, $\Delta i_{40}$, of the output of the high gain amplifier circuit 40 will always be positive. This can be shown by making the substitutions for $\Delta i_8$ and $\Delta i_{11}$, so that the current change, $\Delta i_{40}$, generated by the high gain amplifier circuit 40 becomes:

$$\Delta i_{40} = \Delta V_\gamma \times \left[ g_1 - \frac{1}{\frac{1}{g_1} + R_{18} + \frac{1}{g_{16}}} \right]$$

In this equation, it can be seen that the quantity in brackets will always be a positive number, indicating that an increase or decrease in the voltage, $V_\gamma$, at node $N_\Delta$, will result in an increase or decrease, respectively, in the amplifier current, $i_{40}$, driving FET 14. Cascode connected FETs 9 and 10 ensure that the parasitic resistance, $R_{40}$, at node $N_3$ will be very large so that the change in voltage, $\Delta V_{40}$, produced by amplifier 40 is:

$$\Delta V_{40} = \Delta i_{40} \times R_{40}$$

This change in voltage, $\Delta V_{40}$, which is a large change, typically on the order of 30 to 40 decibels as compared to $\Delta V_\gamma$, is large because $R_{40}$ is large. The change in the voltage, $\Delta V_{40}$, generated by the high gain amplifier circuit 40 significantly changes the current through FET 14 which operates as a voltage controlled current sink. As a result, the voltage, $V_\gamma$, at node $N_\gamma$ changes rapidly to its pre-variation level, thereby stabilizing the bandgap voltage, $V_{BG}$. Because a small change in the voltage, $V_\gamma$, at node $N_\gamma$ causes a large effect in the operation of FET 14, the bandgap generator of the present invention provides a high rejection of any variations in the bandgap voltage, $V_{BG}$, caused by fluctuations in the power supply, $V_{DD}$, or by other sources.

Thus, while there have been shown and described and pointed out fundamental novel features of the invention as applied to a preferred embodiment thereof, it will be understood that various omissions and substitutions and changes in the form and details of the disclosed apparatus, and in its operation, may be made by those skilled in the art without departing from the spirit of the invention. It is the intention, therefore, to be limited only as indicated by the scope of the claims appended hereto.

For example, although N- and P-channel FETs and PNP bipolar transistors are shown, it is understood that the N- and P-channel FETs can be interchanged and NPN bipolar transistors can be substituted for PNP transistors, with corresponding change in polarity of $V_{DD}$, with no significant change in the performance of the bandgap voltage generator of the present invention. Further, it is understood that NPN transistors can be used in place of the shown PNP transistors with the suitable reconfiguration of the transistors. In addition, although a conventional current mirrors are shown, it is understood that another type of current mirror could be substituted, such as Wilson current mirrors. It is also understood that scaling the size of a particular FET can be accomplished-by simply enlarging the width of the FET or by paralleling multiple FETs to achieve the desired size. Additionally, more than one element can be used where only a single element is shown. For example, another one or more cascode connected FETs can be added to the line comprising FETs 8 and 9, additional current mirror FETs can be added, more than one FET can be used in place of voltage regulating FET 14 and/or another resistor can be connected between node $N_2$ and transistor 17, provided that the resistance of resistor 18 is increased by the same amount.

What is claimed is:

1. A bandgap voltage reference generator formed in an integrated circuit for providing a predetermined output bandgap voltage comprising:

a bandgap voltage supply circuit having and input suitable for connection to a voltage power source, a first output generating a voltage output in response to the voltage received by said bandgap voltage supply circuit input from the voltage power source, and a second output generating said predetermined output bandgap voltage in response to the voltage received by said bandgap voltage supply circuit input from the voltage power source, said bandgap voltage supply circuit comprising:

a first current mirror having two outputs and an input, said input of said first current mirror being suitable for connection to the voltage power source, said first output of said first current mirror being coupled to said first output of said bandgap voltage supply circuit;

a first biopolar transistor responsive to said first output of said first current mirror and coupled to said second output of said first current mirror and coupled to said second output of said bandgap voltage supply circuit;

a first resistor responsive to a second output of said first current mirror; and a second biopolar transistor coupled to said first resistor and said first biopolar transistor;

an amplifier circuit receiving the voltage from said first output of said bandgap voltage supply circuit and providing an amplified output signal in response thereto; and a voltage regulator controlled by the output signal of said amplifier and connected to the input of said bandgap voltage supply circuit so that said voltage regulator controls the voltage supplied to said input of said bandgap voltage supply circuit by the voltage power source so as to maintain the output voltage of said bandgap voltage supply circuit at the predetermined output bandgap voltage.

2. The bandgap voltage reference generator of claim 1, wherein said bandgap voltage supply circuit further comprises:

a second current mirror, an input thereof suitable for connection to said voltage power source in parallel to said first current mirror, an output of said second current mirror being coupled to said second output of said bandgap voltage supply circuit; and a second resistor coupled to said first bipolar transistor and said second output of said bandgap voltage supply circuit.

3. The bandgap voltage reference generator of claim 2, wherein said amplifier circuit comprises at least two cascode coupled FETs.

4. The bandgap voltage reference generator of claim 1, wherein said amplifier circuit comprises at least two cascode coupled FETs.

5. The bandgap voltage reference generator of claim 1, wherein said voltage regulator comprises an FET.

6. The bandgap voltage reference generator of claim 2, wherein said voltage regulator comprises an FET.

7. The bandgap voltage reference generator of claim 3, wherein said voltage regulator comprises an FET.

8. The bandgap voltage reference generator of claim 1, wherein said predetermined output bandgap voltage is between 1.0 and 1.5 volts and said voltage power source is between 2.0 and 3.6 volts.

9. The bandgap voltage reference generator of claim 3, wherein said predetermined output bandgap voltage is between 1.0 and 1.5 volts and said voltage power source is between 2.0 and 3.6 volts.

10. The bandgap voltage reference generator of claim 5, wherein said predetermined output bandgap voltage is between 1.0 and 1.5 volts and said voltage power source is between 2.0 and 3.6 volts.

11. A bandgap voltage reference generator formed in an integrated circuit for providing a predetermined output bandgap voltage of between 1.0 and 1.5 volts comprising:

a bandgap voltage supply circuit having an input suitable for connection to a voltage power source, a first output generating a voltage in response to the voltage received by said bandgap voltage supply circuit input from the voltage power source, and a second output generating said predetermined output bandgap voltage in response to the voltage received by said bandgap voltage supply circuit input from the voltage power source, the voltage power source being between 2.0 and 3.6 volts;

an amplifier circuit receiving the voltage from said first output of said bandgap voltage supply circuit and providing an amplified output signal in response thereto; and a voltage regulator controlled by the output signal of said of amplifier and connected to the input of said bandgap voltage supply circuit so that said voltage regulator controls the voltage supplied to said input of said bandgap voltage supply by the voltage power source so as to maintain the output bandgap voltage between 1.0 and 1.5 volts.

12. The bandgap voltage reference generator of claim 11, wherein said amplifier circuit comprises at least two cascode coupled FETs.

13. The bandgap voltage reference generator of claim 11, wherein said voltage regulator comprises an FET.

14. The bandgap voltage reference generator of claim 12, wherein said voltage regulator comprises an FET.

15. A method of reducing the sensitivity of a bandgap voltage generator, formed in an integrated circuit and generating a bandgap voltage of between 1.0 and 1.5 volts, to variations in a power supply voltage supplying a voltage of between 2.0 and 3.6 volts to a bandgap supply circuit of said bandgap voltage generator comprising:

generating a signal proportional to said power supply voltage;

amplifying said signal;

controlling the voltage supplied by said power supply voltage to said bandgap supply circuit in response to said amplified signal so as to maintain the bandgap voltage between 1.0 and 1.5 volts.

16. The method of claim 15, wherein said amplifying is performed by at least two cascode coupled FETs.

* * * * *